US009579779B1

(12) United States Patent
Hunter

(10) Patent No.: US 9,579,779 B1
(45) Date of Patent: Feb. 28, 2017

(54) VALVE SEAT PULLER

(71) Applicant: Jacob Hunter, Elk City, OK (US)

(72) Inventor: Jacob Hunter, Elk City, OK (US)

( * ) Notice: Subject to any disclaimer, the term of this patent is extended or adjusted under 35 U.S.C. 154(b) by 211 days.

(21) Appl. No.: 14/267,035

(22) Filed: May 1, 2014

Related U.S. Application Data

(60) Provisional application No. 61/854,852, filed on May 2, 2013.

(51) Int. Cl.
*B25B 27/02* (2006.01)

(52) U.S. Cl.
CPC ..... *B25B 27/02* (2013.01)

(58) Field of Classification Search
None
See application file for complete search history.

(56) References Cited

U.S. PATENT DOCUMENTS 1,492,877 A * 5/1924 Davis ..... B25B 27/023 29/262
1,652,857 A * 12/1927 Greve ..... B25B 27/023 279/106
3,611,540 A * 10/1971 Gibu ..... B25B 27/023 29/263
3,990,139 A 11/1976 Touchet ..... 29/261
4,507,837 A * 4/1985 Hinkle ..... B25B 27/023 29/262
4,724,608 A * 2/1988 Parrott ..... B25B 27/023 29/253
5,276,951 A * 1/1994 Gluszek ..... B25B 27/062 29/265

* cited by examiner

*Primary Examiner* — Joseph J Hail
*Assistant Examiner* — Brian Keller
(74) *Attorney, Agent, or Firm* — Phillips Murrah PC; Martin G. Ozinga

(57) ABSTRACT

The present invention provides an apparatus, system and method for replacing seats utilizing spring loaded J-shaped hooks on a puller shaft that may be compressed to pass through the seat and expand back to original form to engage the seat from below for pulling upward and removal.

2 Claims, 7 Drawing Sheets

VALVE SEAT PULLER

CROSS-REFERENCE TO RELATED APPLICATIONS

Figure 1:
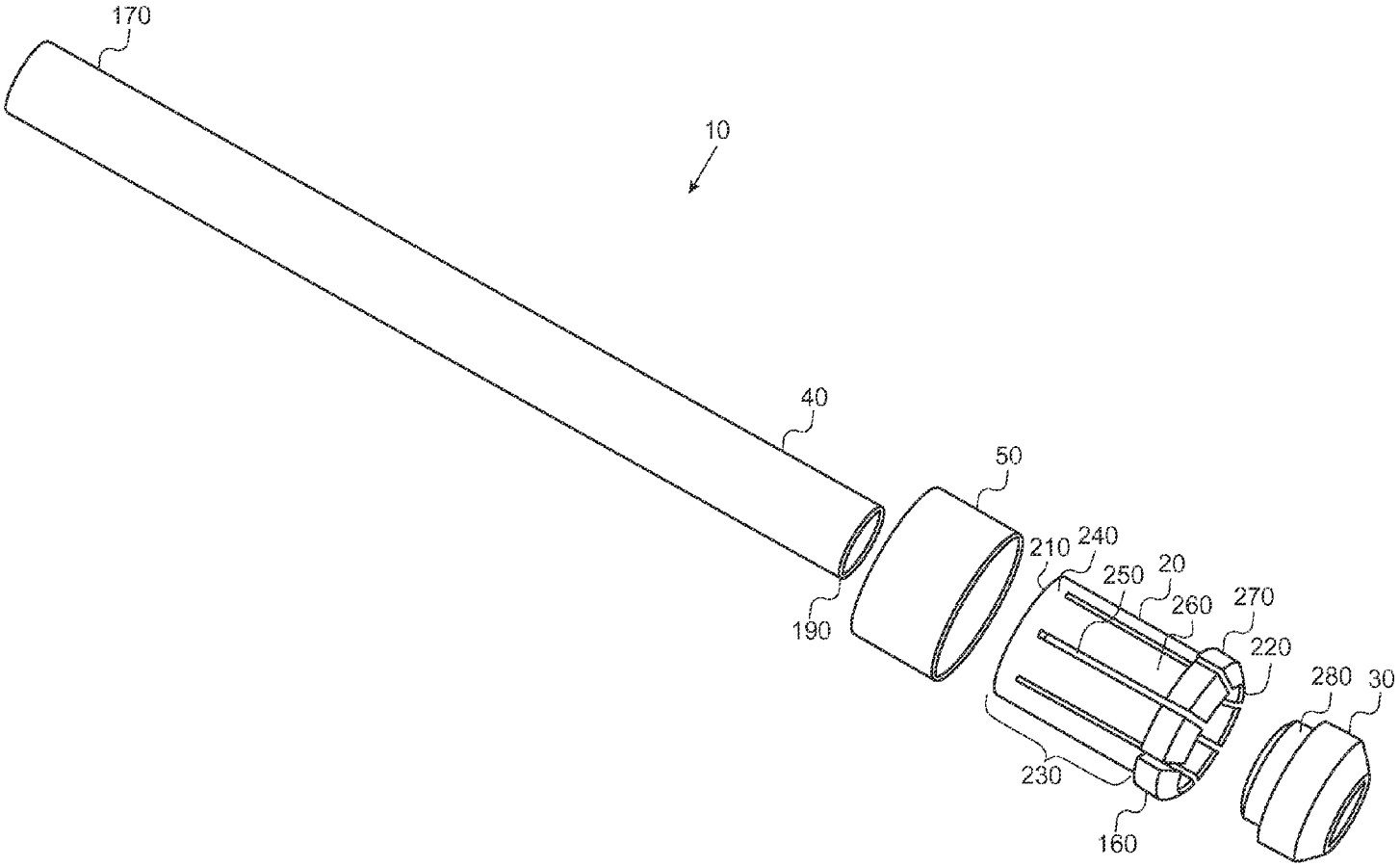

Priority is claimed from provisional patent application U.S. Ser. No. 61/854,852 filed on May 2, 2013, and incorporated by reference herein.

BACKGROUND OF THE INVENTION

1. Field of the Invention

In general, the present invention relates to an apparatus and system for removing seats. More particularly, the present invention provides an improved puller that utilizes spring loaded J-shaped hooks for removing various seats, valve seats, pump liners and so forth from oilfield fracturing pumps, mud pumps, nitrogen pumps, and other equipment found in the oil and gas industry as well as other equipment utilizing same. It is also understood the current invention may be utilized in any other pump type that utilizes replaceable open face seats.

2. Description of the Prior Art

Due to the nature of seats in general, it is often extremely difficult to remove the seat after it is installed. There are many prior art devices for pulling pump valve seats and liners, but most of them are complex and expensive. If a valve seat puller is complex, it consumes time in the removal of the valve seat which translates into money lost during the down time. It is not unusual for the down time in removing a valve seat with prior art devices to run 8-20 hours.

It is understood that in various piston type reciprocating pumps there are valves which open and close in order to direct the flow. The valve mates to a replaceable seat in order to create a seal, stopping the fluid which is being pumped, moving in the direction it is being forced. Over time with the opening and closing of the valves against seat creates wear causing the valves not to seal. The common term used for worn seats is "washed". At this time, the seats must be replaced with new ones.

Valve seats in most pumps are generally slightly tapered, with or without an o-ring, for sealing the seat to the pump head. They are typically held in place by the taper, in that they are pressed into place. When a seat is replaced, it is removed with a puller. There are several different types of pullers used which include a two half puller that spreads out to the inside dimension of the seat by threading the puller shaft inside it, opening the two outer halves far enough to catch the bottom of the seat. This is typically done by two people where one lowers the puller shaft down through the seat, while another person reaches the two half parts of the puller through an open port in the head. The person with the threaded shaft then attempts to thread the puller shaft into the expandable halves. A hydraulic jack, such as hollow shaft jack, is then generally utilized to pull the shaft.

Another commonly used puller is a flat plate that hinges on the bottom of the puller body. It is tipped vertically and then inserted through the seat where gravity causes the flat plate to fall horizontally, thus catching the bottom of the seat and pulled with the same hydraulic jack. These types of pullers fail regularly in that they will not withstand very high pulling pressures. The normal practice at this point, when the pullers have failed, is to call a welder to cut the seat out of the pump with an acetylene torch. This naturally exposes the head of the pump to be "nicked" or cut into with the torch that can cause the head to have to be removed and taken to be repaired.

Another example of a prior art valve seat puller is U.S. Pat. No. 3,990,139 issued to Touchet on Nov. 9, 1976. This device utilizes J-shaped hooks wherein the hooks are essentially individual pieces that work in cooperation and are hinged at the top portion to allow the hooks to spread out and engage the valve seat when in position. These J-shaped hooks are not spring loaded and therefore require a mechanical means to spread the hooks out to engage the seat. More specifically and quoting the issued patent, one embodiment of the pipe pulling apparatus 10 comprises a plurality of J-shaped hooks 24 having a J-shaped end or head 26 and a transverse T-shaped other end 25. The hooks 24 are pivotally supported by its T-shaped end 25 in radial slots 33 of support block or plate 22. In another embodiment, the J-shaped hooks are supported in slots 61 in support block 54 by a transverse T-shaped head portion 57, with the opposite end having a J-shaped head 59 for engaging the lower rim of valve seat 52 when pivoting.

This prior art device has several inherent problems due to the configuration of the individual J-shaped hooks and need for the hooks to pivot by a mechanical means. Needless to say any obstruction in the pivot movement would prevent the J-shaped hook from rotating out for extending and thus would not allow for the hook to catch the valve seat. Dirt and debris in the field associated with the use of pumps is more common than not and frequently inhibited the hook from pivoting as needed. Also of note, rust would frequently inhibit the pivot movement requiring cleaning and lubricating of the part to keep it from binding.

Furthermore, sometime the hook would be stuck in the extended position because the pivot problem. This would mean that the J-shaped hook would not pass through the valve seat opening and often would cause further damage when hitting the valve seat. It is not uncommon for the stuck out J-shaped hook to further push down the seat, damage, it and so forth making it even more difficult to remove.

Still furthermore, the prior art device of U.S. Pat. No. 3,990,139 essentially utilizes a threaded shaft to spread the J-shaped hooks as well as to extract the seat once engaged by use of rotational force for lifting. Current valve seats are typically seated in a tighter fashion making the torque required to rotational lift extremely high which leads to failures, stripping of threads, and damage to motors needed to provide the rotational movement.

It is therefore desirable to provide a valve seat puller and or extractor that provides a spring function to spread the j-shaped hooks to engage the seat when desired and eliminate the need for a mechanical system to engage the hooks. It is also desirable to provide a puller that may be utilized with a hydraulic jack to pull the seat up and out without the need for rotational lifting.

Present day drilling operations are extremely expensive, and an effort to increase the overall efficiency of the drilling operation while minimizing expense requires the essentially continuous operation of the drilling rig. Thus, it is imperative that downtime be minimized. The above discussed limitations in the prior art is not exhaustive. Thus, there is a need for an apparatus, method and system to remove valve seats, pump liners, and so forth easily and quickly. The current invention provides an inexpensive, time saving, more reliable apparatus and system where the prior art fails.

SUMMARY OF THE INVENTION

In view of the foregoing disadvantages inherent in the known types of pullers now present in the prior art, the present invention provides a new and improved apparatus and system which is easier to utilize and more time efficient. As such, the general purpose of the present invention, which will be described subsequently in greater detail, is to provide a new and improved seat puller apparatus and system for replacing seals which has all the advantages of the prior art devices and none or fewer of the disadvantages.

To attain this, the present invention essentially comprises a new and improved assembly that utilizes spring loaded J-shaped hook made from a metal that provides sufficient strength for forces required to pull out the seat, pump liner and so forth, flexible enough to bend as needed to enter the seat, and yet still rigid enough to return to its natural state for repeated use. The invention may be utilized for removing various seats, valve seats, pump liners and so forth from oilfield fracturing pumps, mud pumps, nitrogen pumps, and other equipment found in oil and gas industry as well as other equipment utilizing same. It is also understood the current invention may be utilized in any other pump type that utilizes replaceable open face seats.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved apparatus, system and method for removing and or pulling seats, pump liners, and so forth which may be easily and efficiently utilized.

It is a further object of the present invention to provide a new and improved apparatus, system and method for removing seats, pump liners, and so forth, which is of a durable and reliable construction and may be utilized with multiple types of applications in the oil and gas field as well as other applications.

An even further object of the present invention is to provide a new and improved apparatus, system and method for removing seats, pump liners, and so forth which is generally susceptible to a low cost of manufacture with regard to both materials and labor, and which accordingly is then susceptible to low prices of sale to the consuming industry, thereby making such tool economically available to those in the field.

Still another object of the present invention is to provide a new and improved apparatus, system and method for removing seats, pump liners, and so forth which provides all of the advantages of the prior art, while simultaneously overcoming some of the disadvantages normally associated therewith.

Another object of the present invention is to provide a new and improved apparatus, system and method for removing seats, pump liners, and so forth that does not require a conventional spring assembly and has fewer moving parts than prior art devices.

Yet another object of the present invention is to provide a new and improved apparatus, system and method for removing seats, pump liners, and so forth that may allow for one individual to operate, may be operated with no one having to reach inside a pump head, and generally reduces the risk of injury.

Still another object of the present invention is to provide a new and improved apparatus, system and method for removing seats, pump liners, and so forth which increases the speed of the replacement operation regarding changing out of associated parts.

An even further object of the present invention is to provide a new and improved apparatus, system and method for removing seats, pump liners, and so forth that provides a robust device capable of extreme and numerous uses and may generally withstand much greater amounts of pressure than existing pullers known in the art.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices.

FIG. 1 is generally a depiction of a preferred embodiment of the invention generally showing a partially exploded perspective view of spring catch 20, bottom nose 30, puller shaft 40, and sleeve 50 in accordance with the current invention.

Figure 2:
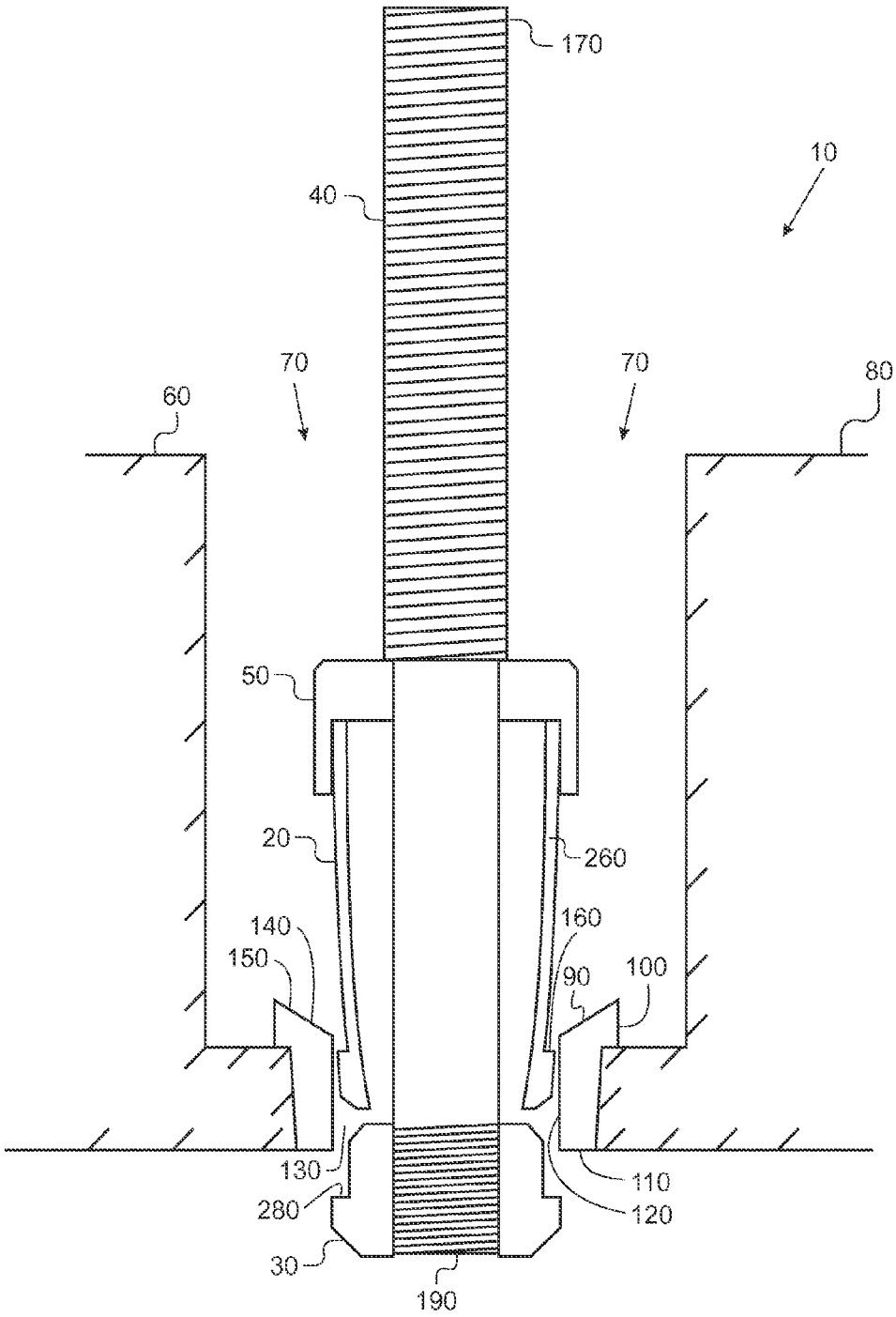

FIG. 2 is generally a depiction of a preferred embodiment of the invention generally showing a cutaway side view as utilized in a pump and generally depicting spring catch 20 bottom 220 and or segment(s) 260 distal end(s) 270 passing through valve seat 90 after compression of spring catch 20 in accordance with the current invention.

Figure 3:
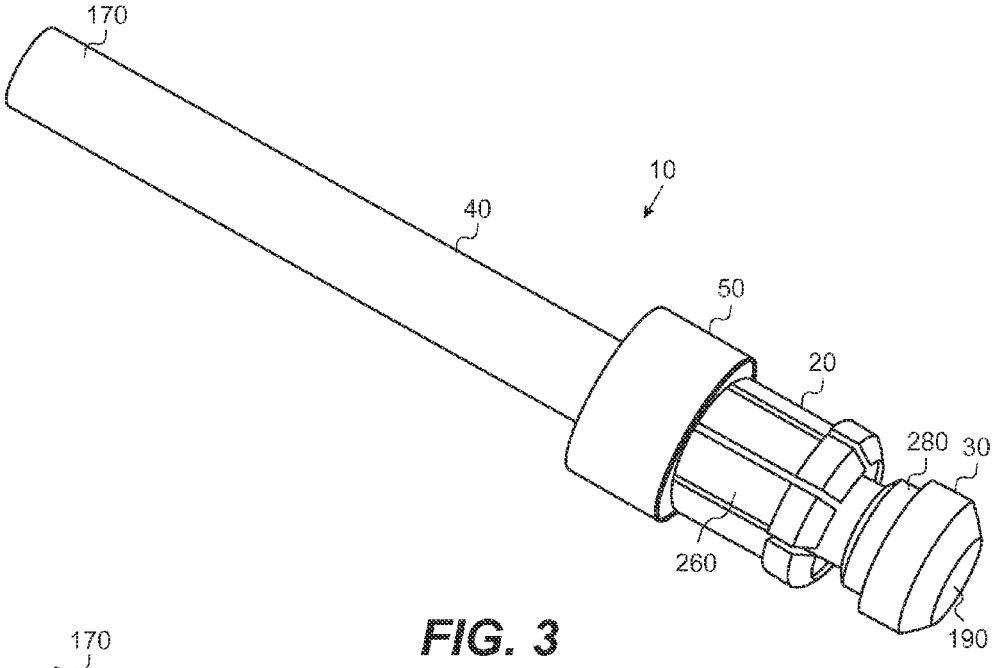

FIG. 3 is generally a depiction of a preferred embodiment of the invention generally showing a perspective view of spring catch 20, bottom nose 30, puller shaft 40, and sleeve 50 wherein spring catch 20 is generally in an upward position sleeve 50 in accordance with the current invention.

Figure 4:
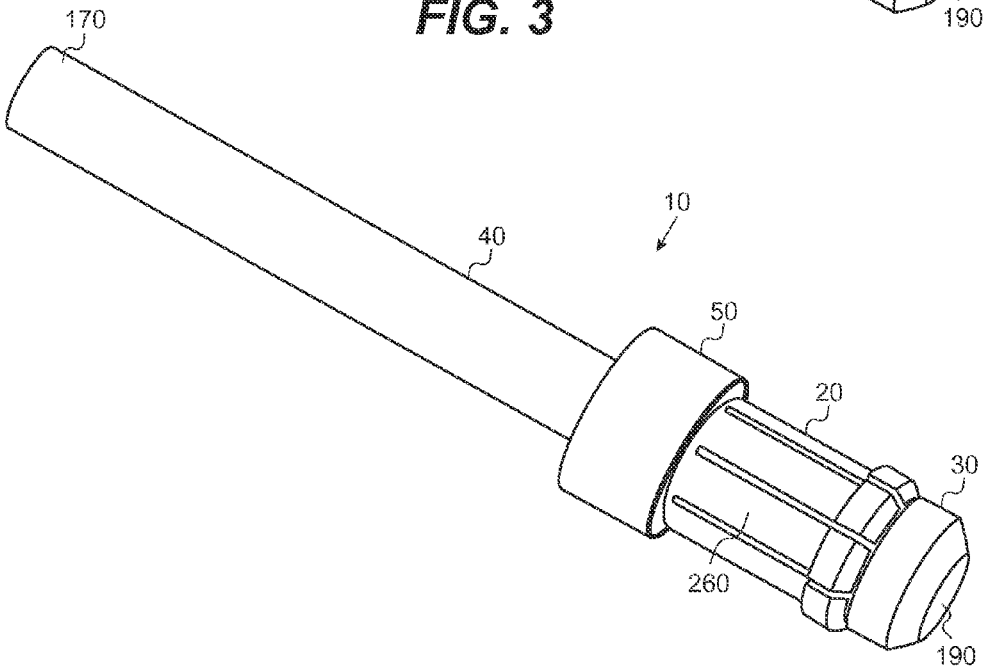

FIG. 4 is generally a depiction of a preferred embodiment of the invention generally showing a perspective view of spring catch 20, bottom nose 30, puller shaft 40, and sleeve 50 wherein spring catch 20 is generally in a downward position relative to sleeve 50 and bottom 220 of spring catch 20 in communication with bottom nose 30 recessed lip portion 280 in accordance with the current invention.

Figure 5D:
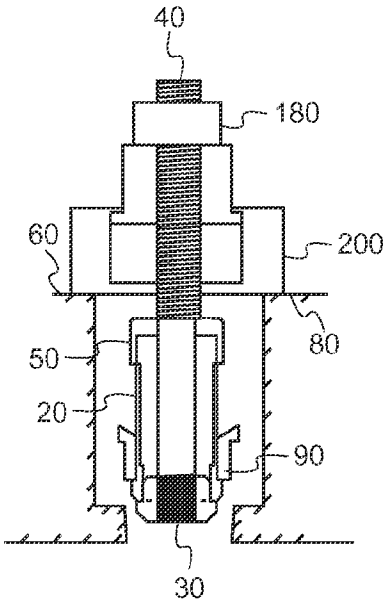
Figure 5C:
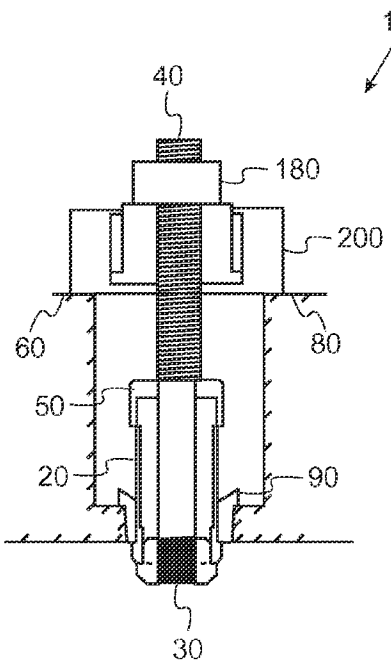
Figure 5B:
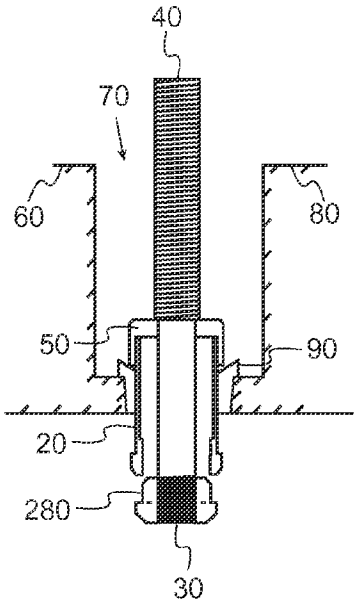
Figure 5A:
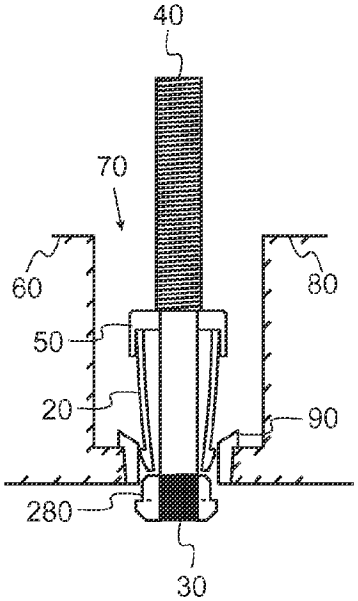

FIG. 5A is generally a preferred embodiment of the invention depicting spring sleeve 20 in compression as it passes through valve seat 90 in accordance with the current invention.

FIG. 5B is generally a preferred embodiment of the invention depicting spring sleeve 20 after it has passed completely through valve seat 90 with spring catch 20 no longer in compression in accordance with the current invention.

FIG. 5C is generally a preferred embodiment of the invention depicting spring sleeve 20 after it has passed completely through valve seat 90 with spring catch 20 no longer in compression and in communication with valve seat 90 as jack 200 is lifting to remove valve seat 90 in accordance with the current invention.

FIG. 5D is generally a preferred embodiment of the invention depicting spring sleeve 20 after it has passed completely through valve seat 90 with spring catch 20 no longer in compression and in communication with valve seat 90 after jack 200 has lifted and removed seat 90 in accordance with the current invention.

Figure 6A:
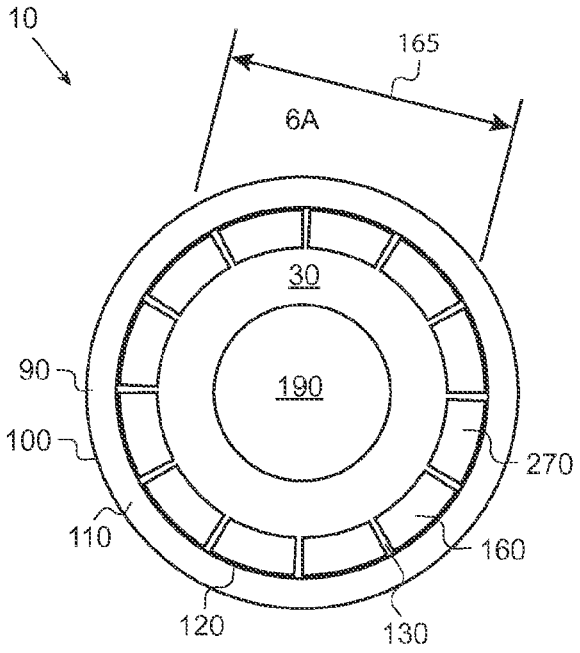

FIG. 6A is generally a depiction of a preferred embodiment of the invention generally showing a bottom view where in spring catch 20 is in compression and passing through valve seat 90 while bending into smaller circumference 165 in accordance with the current invention.

Figure 6B:
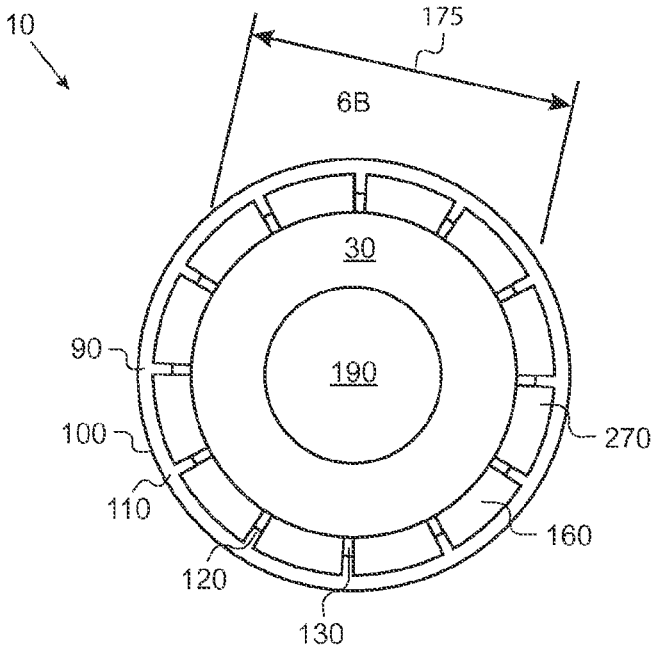

FIG. 6B is generally a depiction of a preferred embodiment of the invention generally showing a bottom view where spring catch 20 is no longer in compression and returned to original circumference 175 thus allowing J-shaped hooks 160 to engage the lower rim 110 of valve seat 90 for pulling upward and out in accordance with the current invention.

Figure 7:
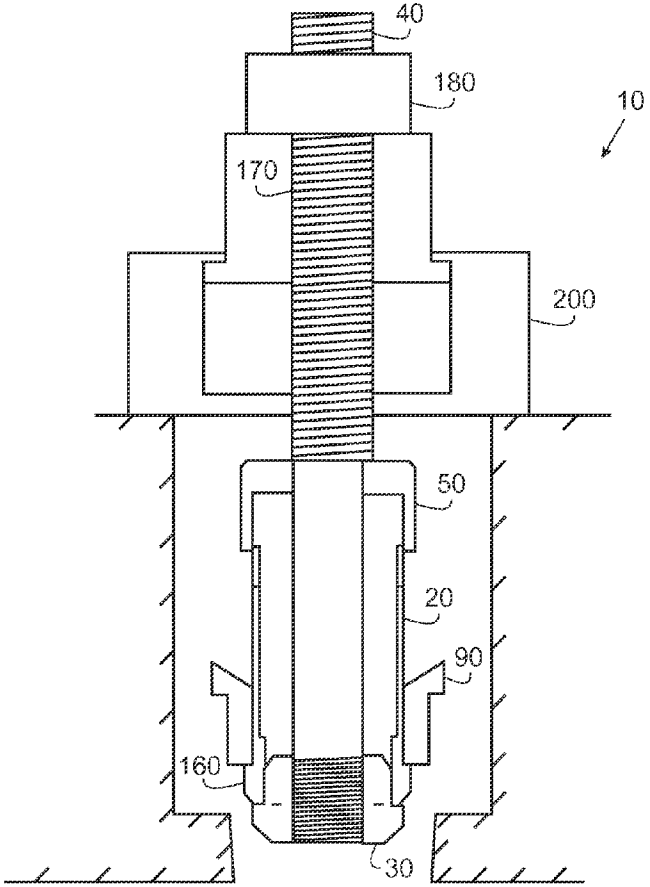

FIG. 7 is generally a preferred embodiment of the invention depicting spring sleeve 20 after it has passed completely through valve seat 90 with spring catch 20 no longer in compression and in communication with valve seat 90 after jack 200 has lifted and removed valve seat 90 in accordance with the current invention. This depiction is essentially a larger image of FIG. 5D.

Figure 8:
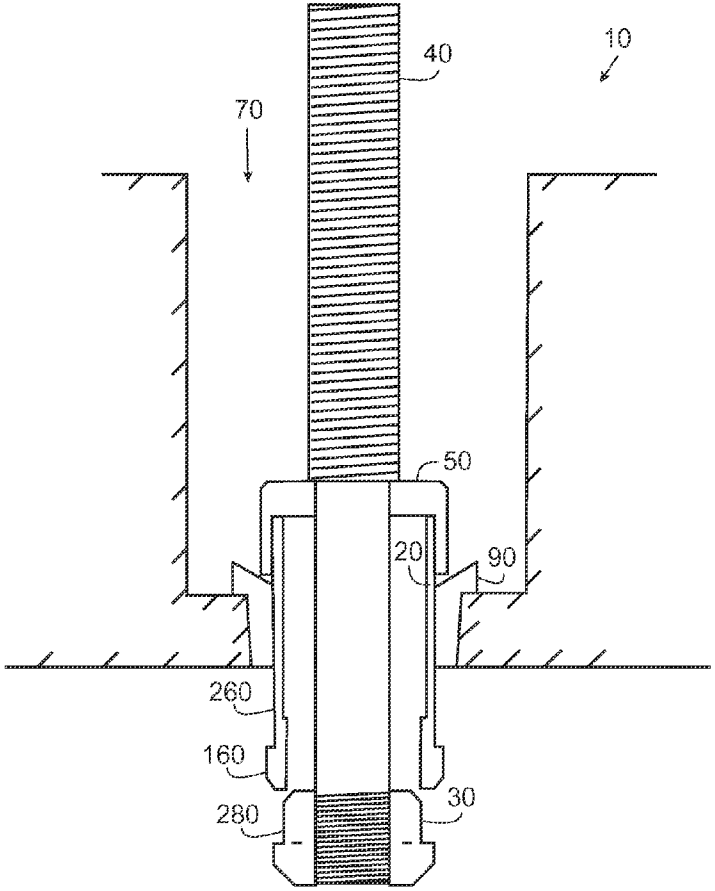

FIG. 8 is generally a preferred embodiment of the invention depicting spring sleeve 20 after it has passed completely through valve seat 90 with spring catch 20 no longer in compression in accordance with the current invention. This depiction is essentially a larger image of FIG. 5B.

Figure 9:
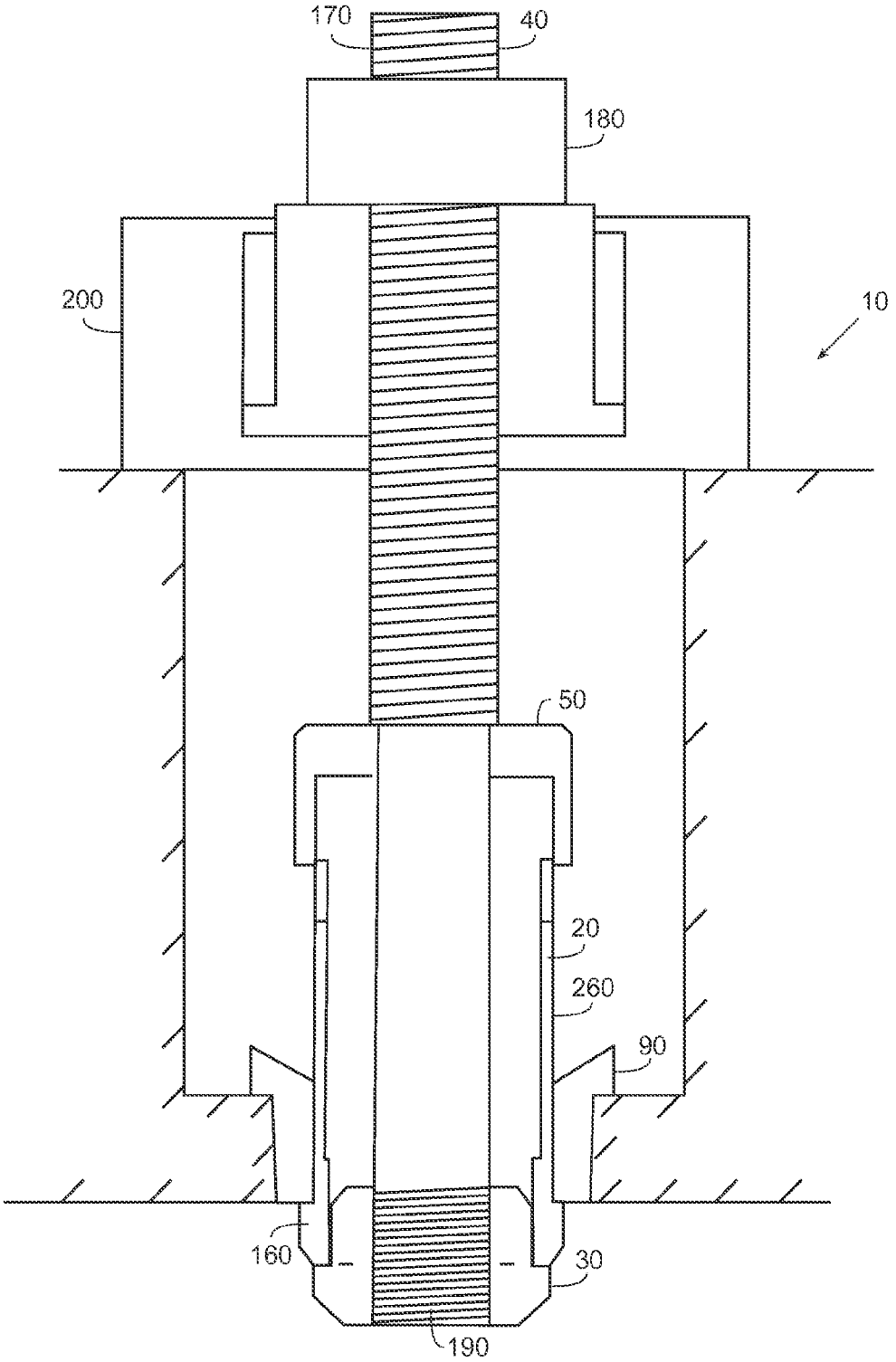

FIG. 9 is generally a preferred embodiment of the invention depicting spring sleeve 20 after it has passed completely through valve seat 90 with spring catch 20 no longer in compression and in communication with valve seat 90 as jack 200 is lifting to remove valve seat 90 in accordance with the current invention. This depiction is essentially a larger image of FIG. 5C.

DETAILED DESCRIPTION OF THE PREFERRED EMBODIMENTS

Referring to the illustrations, drawings, and pictures, reference character 10 generally designates a new and improved puller device, assembly, system and method of using same constructed in accordance with the present invention. Invention 10 is generally used in oil and gas well operations but may be utilized in other applications. The current invention should not be considered limited to just seat, valve seat, pump liners, and so forth removal.

Now Referring to the illustration and more in particular to FIG. 1, invention 10 may include spring catch 20, bottom nose 30, puller shaft 40, and sleeve 50 generally positioned axially as depicted in the illustrations as will be discussed further below.

Again referring to the drawings in general and more specifically to FIG. 2, invention 10 may generally be utilized with a pump assembly 60. A portion of the invention 10 is generally depicted being inserted into opening 70 of a pump or pump head 80 for engaging stuck valve seat 90. Valve seat 90 comprises an outer diameter or ring 100 having a lower rim or bottom face 110 and an inner diameter or ring 120. The inner diameter 120 has an aperture 130. Valve seat 90 may also include a top face or portion 140 having an angled surface 150.

Spring catch 20 may be generally cylindrical and made from a metal alloy that allows for flexing and or bending, durable for the force required and also rigid enough to return to its original shape after flexing or bending. A preferred construction may be made from American Iron and Steel Institute , also known as AISI, 8620 alloy steel that is a hardenable chromium, molybdenum, nickel low alloy steel often used for carburizing to develop a case-hardened part.

| Its chemical properties may be: | |
|---|---|
| Carbon | 0.18-0.23 |
| Chromium | 0.4-0.6 |
| Manganese | 0.7-0.9 |
| Molybdenum | 0.15-0.25 |
| Nickel | 0.4-0.7 |
| Phosphorus | 0.035 max |
| Silicon | 0.15-0.35 |
| Sulphur | 0.04 max |
| **Its physical properties may be:** | |
| Density (lb/cu. in.) | 0.283 |
| Specific Gravity | 7.8 |
| Specific Heat (Btu/lb/Deg F-[32-212 Deg F]) | 0.1 |
| Melting Point (Deg F) | 2600 |
| Thermal Conductivity | 26 |
| Mean Coeff Thermal Expansion | 6.6 |
| Modulus of Elasticity Tension | 31 |

Spring catch 20 is generally formed of J-shaped hooks 160 that allow for flexing and or bending. A preferred embodiment is of a one piece construction having twelve (12) J-shaped hooks 160 although more or less J-shaped hooks 160 may be utilized. The spacing between the J-shaped hooks 160 generally allows for the circumference to be made smaller when the J-shaped hooks 160 are compressed such as but not limited to bending into a smaller circumference 165. The spring quality of the design allows for the J-shaped hooks 160 to return to the original spacing when not compressed such as but not limited to going back to the original circumference 175. Puller shaft 40 may generally be threaded and utilized to hold spring catch 20 and sleeve 50. It may be rotated for the desired lifting and lowered from above by hydraulic means, mechanical means, and combinations thereof. Invention 10 contemplates utilization with a hydraulic jack puller shaft 40 may be made of steel known in the industry and have threading known in the industry. Puller shaft 40 may generally comprise a top or top portion 170 that may attach to a nut 180 for holding puller shaft 40 in a relatively fixed position in opening 70 of pump head 80 while allowing the puller shaft 40 to move up and down as desired. The movement may be accomplished through hydraulic, mechanical and combinations thereof as known in the art. Bottom or bottom portion 190 of puller shaft 40 may generally be utilized to removably hold bottom nose 30.

Bottom nose 30 may be made from steel and or other materials known in the art. Bottom nose 30 may generally be removably threaded onto and axially aligned with puller shaft 40 bottom portion 190. It is understood that numerous types of removable connections to puller shaft 40 are contemplated.

Sleeve 50 may also be constructed from steel and other materials known in the art. It is contemplated that sleeve 50 is generally fixed axially on puller shaft 40 and generally holds spring catch 20 and allows spring catch 20 to move up and down, relative to puller shaft 40, while being trapped at the top of spring catch 20 inside sleeve 50. Generally this configuration provides a "floating" spring catch 20 inside sleeve 50. It is also contemplated that invention 10 may not utilize sleeve 50, sleeve 50 may be incorporated into spring catch 20, sleeve 50 may be generally non-movably fixed to spring catch 20, combinations thereof, and so forth. Sleeve 50 may generally look like a cup and or cap fixed and or removably fixed on puller shaft 40 with threads, welds, and so forth.

Now again refereeing to the illustrations and more in particular to FIGS. 3 through FIGS. 9, generally, the puller shaft 40 is inserted in through the valve seat 90 from the top of the pump head 80 by inserting the puller shaft 40 bottom nose 30 down hole or opening 70 until bottom nose 30 passes valve seat 90 and sleeve 50 contacts top of valve seat 90 bringing puller shaft 40 essentially to a stop. Sleeve 50 may also generally function as a general guide for passing spring catch 20 through the pump assembly 60 as well as an indicator when the puller shaft 40 has descended far enough into the pump assembly 60 to engage valve seat 90.

It is then contemplated that a hollow shaft hydraulic jack 200 is put onto the puller shaft 40 and secured by nut 180. At this point, the valve seat 90 is pulled by the hydraulic jack 200 upward. It is contemplated that invention 10 will allow for a generally vertical removal of valve seat 90 without the need for a rotational force as the prior art devices. It is also contemplated that puller shaft 40 may not be threaded. It is still further contemplated that top or top portion 170 of puller shaft 40 may be formed and or adapted to attach and or communicate with a hydraulic jack 200 as known in the prior art.

The improved design of invention 10 generally pushes steel spring catch 20 through valve seat 90 and then springs back once passing the bottom face 110 of valve seat 90. J-shaped hooks 160 are essentially forced into bending into a smaller circumference 165 as the downward force on spring catch 20 contacts with the angle of surface 150 of valve seat 90. After the J-shaped hooks 160 clear the bottom face 110 of valve seat 90, they are allowed to spring back and or unbend to the original circumference 175 thus allowing the J-shaped hooks 160 to engage the lower rim 110 of valve seat 90 for pulling upward and out.

The bottom nose 30 of invention 10 is pulled up inside of the spring catch 20, causing the spring catch 20 to be held rigid and not allowing it to close. Thus creating a near solid ring of steel at bottom 190 of the puller shaft 40 just below bottom face 110 of valve seat 90. The yield strength of this ring may be greater than that of the hydraulic jacks 200 currently being used to pull valve seats 90.

Once the seat is removed from the pump, the bottom nose 30 of the invention 10 may then be removed by simply loosening it from the puller shaft 40 by hand. Steel spring catch 20 is then slid off of puller shaft 40, and then valve seat 90 may be slid off. Steel spring catch 20 may then be placed back on puller shaft 40 and bottom nose 30 may then be threaded back until it stops turning. Current invention 10 generally requires no tools to be assembled or disassembled.

Spring catch 20 may generally be a one piece hollow cylindrical construction having a top 210, a bottom 220, a length 230, and wall 240. Top 210 is generally a solid ring whereas wall 240 has split(s) and or slit(s) 250 for forming protrusion(s) and or segment(s) 260 along wall 240. It is contemplated that spring catch 20 may be hollow and have an aperture and or opening through length 230 with an open ended top 210 and bottom 220. It is also understood that top 210 may not be open and have a solid portion not depicted.

A J-shaped hook or hooks 160 is generally formed from segments 260 wherein the distal end(s) 270 has a J-shaped end(s). It is also understood that distal end(s) 270 may look more like an L-shape and the term J-shaped should not be considered to limit the invention to such. Generally top 210 is formed not to flex and or compress but remain essentially rigid. Slits(s) 250 allow segment(s) 260 to change the circumference of bottom 220 from un-flexed and or non compressed spring catch 20 of original circumference 175 to a flexed and or compressed smaller circumference 165. Generally, compression and or flexion occur when segment(s) 260 bend inward. It is contemplated top 210 does not bend nor bottom 220. Distal end(s) 270 are contemplated to also stay generally rigid.

It is further contemplated bottom nose 30 may include a recessed lip portion 280 wherein after engagement of valve seat 90 by spring catch 20, distal end(s) 270 of J-shaped hook or hooks 160 are generally trapped against bottom nose 30 after spring catch 20 slides into position for extraction. It is contemplated that this may generally add structural support to bottom 220 of spring catch 20 as well as keep spring catch 20 in original circumference 175 during the removal process.

Changes may be made in the combinations, operations, and arrangements of the various parts and elements described herein without departing from the spirit and scope of the invention. Furthermore, names, titles, headings and general division of the aforementioned are provided for convenience and should, therefore, not be considered limiting.

What is claimed is:

1. A valve seat puller for removing a valve seat from a pump wherein said valve seat has an outer diameter, a bottom face, an inner diameter, an aperture defined by said inner diameter, and a top face, said valve seat puller comprising:

a puller shaft having a top, a threaded bottom, and a length defined between said top and said bottom;

a spring catch having a top axially positioned on said length of said puller shaft length and a one-piece construction comprising:

a hollow cylinder having a top, a bottom, a wall, a plurality of slits on a length of said wall starting below said top thereby forming a plurality of segments protruding down from said top wherein said plurality of segments each have a distal end forming said bottom of said spring catch and wherein each said distal end is a J-shaped hook adapted to bend inward when contacting said top face of said valve seat, pass through said inner diameter of said valve seat, and unbend after passing through said seat valve inner diameter wherein said J-shaped hooks can engage said bottom face of said valve seat for lifting said valve seat from said pump;

a sleeve axially positioned on said puller shaft said length and adapted to hold said top of said spring catch while allowing said spring catch to float up and down relative to said puller shaft said length; and a bottom nose axially aligned with said puller shaft, having a recessed lip portion comprising a flat surface perpendicular to said length of said puller shaft and having an outer diameter, a vertical surface parallel to said length of said puller shaft and having a smaller outer diameter than said outer diameter of said flat surface, adapted to trap said J-shaped hooks against said vertical surface of said lip portion and on said flat surface of said recessed lip portion while said J-shaped hooks engage said bottom face of said of said valve seat, and having threads for removably threading onto said threaded bottom of said puller shaft.

2. The valve seat puller of claim 1 wherein said spring catch is made from AISI 8620 alloy steel.

* * * * *